US009761366B2

(12) United States Patent
Weber et al.

(10) Patent No.: US 9,761,366 B2
(45) Date of Patent: Sep. 12, 2017

(54) DRY-TYPE TRANSFORMER

(71) Applicant: ABB Technology AG, Zürich (CH)

(72) Inventors: Benjamin Weber, Winterberg (DE); Michael Luckey, Marsberg (DE); Wolfgang Mönig, Brilon (DE); Marcos Bockholt, Paderborn (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/158,084

(22) Filed: Jan. 17, 2014

(65) Prior Publication Data

US 2014/0132381 A1 May 15, 2014

Related U.S. Application Data

(63) Continuation of application No. PCT/EP2012/002555, filed on Jun. 16, 2012.

(30) Foreign Application Priority Data

Jul. 18, 2011 (EP) ..... 11005855

(51) Int. Cl.
*H01F 27/08* (2006.01)
*H01F 27/06* (2006.01)
(Continued)

(52) U.S. Cl.
CPC ..... *H01F 27/10* (2013.01); *H01F 3/00* (2013.01); *H01F 5/00* (2013.01); *H01F 27/025* (2013.01);
(Continued)

(58) Field of Classification Search
CPC .. H01F 2027/328; H01F 27/085; H01F 27/10; H01F 27/05; H01F 6/04; H01F 27/06; H01F 27/02; H01F 27/2876
(Continued)

(56) References Cited

U.S. PATENT DOCUMENTS 1,342,304 A * 6/1920 Steinberger ..... H01F 17/02 336/205
1,624,896 A * 4/1927 Veitch ..... H01F 27/306 336/185
(Continued)

FOREIGN PATENT DOCUMENTS

EP 1715495 A2 10/2006

OTHER PUBLICATIONS

International Search Report (PCT/ISA/210) dated Oct. 4, 2012, by the European Patent Office as the International Searching Authority for International Application No. PCT/EP2012/002555.

*Primary Examiner* — Elvin G Enad
*Assistant Examiner* — Joselito Baisa
(74) *Attorney, Agent, or Firm* — Barnes & Thornburg LLP

(57) ABSTRACT

A dry-type transformer for mobile applications includes a transformer core, at least one radially inner first winding segment, and at least one radially outer, second hollow cylindrical winding segment. The segments are wound around a common winding axis and the transformer core passes therethrough. The segments are nested inside one another and radially spaced apart from one another, such that a hollow cylindrical cooling duct is formed therebetween. Spacing is achieved by spacer elements arranged such that the cooling duct allows a passage of coolant in an axial direction. The spacer elements are formed and arranged along the radial circumference of the cooling duct over the axial length thereof such that the proportionate weight of the horizontal transformer can be borne on at least one contact surface of the at least second winding segment without causing deformation to the cooling duct.

14 Claims, 3 Drawing Sheets

(51) Int. Cl.

| | |
|---|---|
| ***H01F 27/10*** | (2006.01) |
| ***H01F 27/02*** | (2006.01) |
| ***H01F 27/28*** | (2006.01) |
| ***H01F 27/32*** | (2006.01) |
| ***H01F 3/00*** | (2006.01) |
| ***H01F 5/00*** | (2006.01) |

(52) U.S. Cl.
CPC ..... *H01F 27/2876* (2013.01); *H01F 27/322* (2013.01); *H01F 27/327* (2013.01); *H01F 2027/328* (2013.01)

(58) Field of Classification Search
USPC ..... 336/58, 60, 82, 90, 207, 65, 68, 20, 41
See application file for complete search history.

(56) References Cited

U.S. PATENT DOCUMENTS 2,544,845 A * 3/1951 Link ..... 336/60
2,863,130 A * 12/1958 Gray et al. ..... 336/207
2,918,639 A * 12/1959 Beymer ..... H01F 27/306 336/185
2,990,528 A * 6/1961 Zimsky et al. ..... 336/58
3,086,184 A * 4/1963 Nichols ..... H01F 27/322 336/192
3,301,600 A * 1/1967 Bland ..... E21D 9/11 299/33
3,386,058 A * 5/1968 Michel ..... 336/60
3,447,112 A * 5/1969 Broverman ..... H01F 27/085 336/185
3,708,875 A * 1/1973 Martincic ..... H01F 27/2847 29/602.1
4,129,845 A * 12/1978 Benke ..... H01F 27/18 174/15.1
4,129,938 A * 12/1978 Hagenbucher ..... H01F 41/04 156/173
4,774,451 A * 9/1988 Mehnert et al. ..... 323/263
5,138,294 A * 8/1992 Yoshikawa ..... 336/60
5,383,266 A 1/1995 Soter
5,588,201 A * 12/1996 Alber ..... H01F 41/127 29/602.1
5,651,175 A * 7/1997 Grimes ..... H01F 27/322 29/602.1
7,647,692 B2 * 1/2010 Lanoue et al. ..... 29/609
2011/0063062 A1 3/2011 Lim et al.
2014/0118946 A1 * 5/2014 Tong ..... H05K 7/20909 361/704

* cited by examiner

DRY-TYPE TRANSFORMER

RELATED APPLICATIONS

This application claims priority as a continuation application under 35 U.S.C. §120 to PCT/EP2012/002555, which was filed as an International Application on Jun. 16, 2012 designating the U.S., and which claims priority to European Application 11005855.9 filed in Europe on Jul. 18, 2011. The entire contents of these applications are be hereby incorporated by reference in their entireties.

FIELD

The present disclosure relates to a dry-type transformer for mobile applications.

BACKGROUND INFORMATION

It is known that corresponding line-connected supply grids can be available for the transmission of electrical energy. Depending on the electrical power to be transmitted, these supply grids have a rated voltage of, for example, 380 kV, 110 kV or else 10 kV, wherein a mains frequency of 50 or 60 Hz can be used. A supply grid for the supply of power to stationary consumers can have a three-phase design. In this case, a system with three supply lines is made available in which, in the balanced state, current and voltage can be equal in terms of magnitude with a phase shift of in each case 120° with respect to one another.

Energy supply systems for mobile consumers such as, for example, railways or tram systems can have a single-phase design. The supply of power takes place via a single supply line, wherein the return line is then provided via the metallic rail. In the case of trolleybuses, owing to the rail which is not present and therefore cannot be used as return conductor, two or more supply lines can be provided. In general, the mains frequency in such applications is 16⅔ hertz, for example, in Europe, and in some cases such as tram systems, in individual cases DC voltage is also used.

For the transformation of the AC supply voltage from 10 kV to 15 kV, mobile transformers can be provided which can then be integrated, for example, in the underfloor region of a passenger train.

These transformers only have a very limited amount of room available, in particular in respect of height, owing to the underfloor arrangement and are usually in the form of oil-type transformers. In this case, the oil first acts as coolant for dissipating the lost heat produced during operation and also as insulation, by means of which relatively small insulation gaps and therefore a compact design can be realized.

One disadvantage with this configuration, however, is that such a transformer can usually only be arranged vertically for mechanical reasons, but this is in opposition to the flat space available in the underfloor region. In addition, for safety reasons, oil should wherever possible be avoided as combustible medium in a vehicle. In this case, the cooling effect of the oil is lost.

SUMMARY

An exemplary embodiment of the present disclosure provides a dry-type transformer for mobile applications. The dry-type transformer includes a transformer core, at least one radially inner first hollow-cylindrical winding segment, and at least one radially outer second hollow-cylindrical winding segment. The winding segments are wound around a common winding axis, have the transformer core passing through them, are nested one inside the other, and are spaced radially apart from one another such that a hollow-cylindrical cooling channel is developed therebetween. The dry-type transformer also includes spacer elements arranged to space apart the winding segments. The spacer elements are arranged such that a coolant is flowable through the cooling channel in the axial direction. The spacer elements are developed and arranged along a radial circumference of the cooling channel over an axial length thereof such that a proportional weight of the dry-type transformer arranged horizontally can be evened out exclusively at precisely one resting area of the at least one second winding segment without deformation of the cooling channel taking place.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
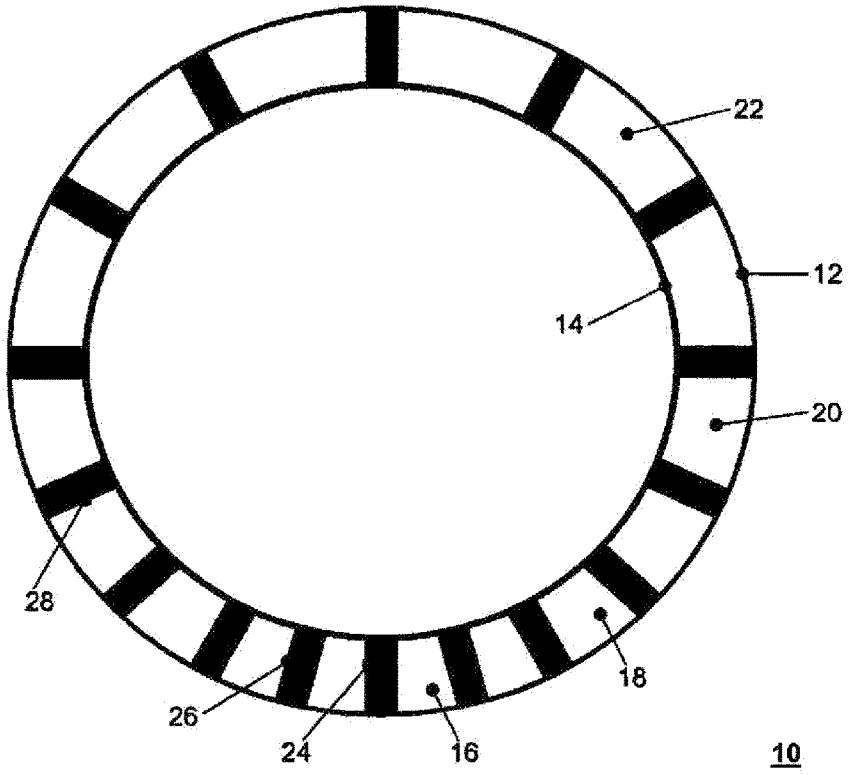
FIG. 1 shows a section through a hollow-cylindrical cooling channel according to an exemplary embodiment of the present disclosure.

Exemplary embodiments of the present disclosure provide a dry-type transformer for mobile applications which can be arranged as flexibly as possible.

According to an exemplary embodiment, the dry-type transformer of the present disclosure is characterized by spacer elements being developed and arranged along the radial circumference of the cooling channel over the axial length thereof in such a way that the proportional weight of the horizontal transformer can be evened out on at least one resting area of the at least one second winding segment without deformation of the cooling channel or of the dispersion channel formed thereby.

By virtue of the omission of oil as a coolant which dissipates the lost heat produced during operation, for example, to a heat exchanger, an alternative cooling system needs to be provided which functions without oil, for example, with air. Owing to the lower heat capacity of air, a much larger contact area between the transformer winding and the cooling medium is therefore provided according to the disclosure. In addition, an increased throughput of coolant, for example by means of a fan, is advantageous.

This is achieved in particular by the cooling channels which can be provided between the hollow-cylindrical winding segments which can be nested one inside the other. The winding segments can be used firstly for influencing the short-circuit impedance of the dry-type transformer according to the disclosure, i.e. should be considered to be dispersion channels, insofar as they can be arranged between two galvanically isolated winding segments. Secondly, the winding segments can be used for cooling the transformer winding from the inside. That is to say that the disclosure provides for a coolant, in particular air, to be allowed to flow in a forced manner through these cooling channels. Air provides the advantage that the heated air can be emitted directly to the surrounding environment without any additional heat exchangers. According to the disclosure, optionally also further cooling channels can be provided, for example between a plurality of winding segments connected in series which form a low-voltage winding or high-voltage winding, for increasing the cooling area. However, as a result the required amount of space for the dry-type transformer according to the disclosure is increased in comparison with a comparable oil-type transformer.

Therefore, the present disclosure provides for the transformer to be arranged horizontally, with the result that the winding axis of the windings therefore runs in a horizontal plane. As a result, a particularly flat and more two-dimensional design of the transformer is achieved which is in opposition to the space available in the underfloor region which is flat but has a large area.

The spacing of the hollow-cylindrical winding segments is provided by spacer elements composed of an insulating material, by means of which support in the at least predominantly radial direction with respect to the winding axis is provided. Such a dry-type transformer in accordance with known configurations is erected vertically. This is due to cooling technology reasons, namely that cooling channels extending along the winding axis can then be operated by natural cooling by virtue of ambient air flowing from the bottom upwards through the cooling channels. However, this is secondly also required mechanically. Given a vertical arrangement, the transformer is positioned on the lower side of its transformer core, whereby its entire weight, for example 500 kg to 1000 kg, can be evened out directly via the resting area of the transformer core onto the standing area. The windings arranged on the limbs of the transformer core can be therefore aligned vertically and can therefore be predominantly subjected to the forces of weight in the direction of the winding axis. A force loading in the winding in a direction radial with respect to the winding axis does not take place with a vertical alignment of the transformer.

Owing to the force loading in the radial direction which may not be present or only insubstantial, the supporting elements of the cooling channels of a dry-type transformer of known configurations can also be correspondingly not designed for such a radial force loading. Nevertheless, the present disclosure provides for it to be possible for the dry-type transformer to be arranged or at least mounted horizontally on corresponding resting areas of its windings. Even when a dry-type transformer in the underfloor region is fastened predominately on the sides of its transformer core, with the result that actually the weight of the transformer would not need to be evened out over the windings, the transformer core of the transformer, with a length of 2 m, for example, is so long that bending of the transformer core takes place as a result of the force of gravity. Therefore, even in this case, in accordance with an exemplary embodiment of the present disclosure, the winding needs to toughen up in order to absorb increased radially acting forces in order to counteract bending.

In order to implement the horizontal arrangement of the dry-type transformer according to the present disclosure, on corresponding resting areas of the outer faces of the windings, the respective windings need to also toughen up correspondingly for absorbing radial force loads. According to the present disclosure, therefore, provision is made for the arrangement of spacer elements to be condensed correspondingly in regions which can provide for a specific horizontal arrangement position of the transformer, with the result that the maximum compressive stress per basic area of a spacer element is not exceeded even in the horizontal position of the dry-type transformer. Alternatively to an insulating material such as a glass-fiber-reinforced composite material or pressboard, for example, the use of a metal for a spacer element, for example, a solid aluminum profile, is also conceivable depending on the stress ratios over the cooling channel if the cooling channel is located between a plurality of segments of a low-voltage winding of, for example, 400 V. In this case, owing to the low stress loading, no insulation capacity of the spacer element is required; instead, this is performed already by the insulation of the winding conductor. An exemplary physical size of a transformer according to the present disclosure including a two-limbed core has, for example, a length of 1.5 m-2.5 m, a height of 0.75 m and a width of 1.5 m.

The dry-type transformer according to the present disclosure advantageously avoids the use of oil and nevertheless provides corresponding cooling possibilities. In addition, it is configured by virtue of its horizontal arrangement with a flat design, with the result that it can be integrated easily into the underfloor region of a locomotive or car. By virtue of selective reinforcement or condensing of the spacer elements in the cooling channels, a corresponding stabilization of the winding(s) is performed for a horizontal position of the transformer in order to even out the overall weight of the dry-type transformer towards the bottom.

In accordance with an exemplary embodiment of the dry-type transformer of the present disclosure, the at least one second winding segment has precisely one respective (e.g., preferred) resting area, via which the proportional weight of the horizontal transformer can be exclusively evened out without deformation of the cooling channels taking place. The dry-type transformer then has a specific horizontal preferred position. Thus, the spacer elements need to be reinforced or condensed only for the preferred position, with the result that the complexity for the reinforcing is reduced to a minimum.

In accordance with an exemplary embodiment of the disclosure, the spacer elements can be arranged in condensed form in the radial direction with respect to the respective resting area, with the result that an increased capacity for radial compressive stress results in the corresponding regions of the cooling channel. In principle, with the material provided for the spacer elements, there is the possibility of the spacer elements being arranged in the corresponding regions either with a smaller spacing with respect to one another, i.e. condensed, or else the width or contact areas of the spacer elements being increased correspondingly.

In accordance with an exemplary embodiment of the present disclosure, the spacer elements can be in the form of strips or channels and can extend along the winding axis. As a result, the hollow-cylindrical cooling channel is divided into a plurality of cooling channels running in the axial direction in a favorable manner in terms of flow technology. The cooling effect is thus advantageously improved and homogenized.

In accordance with an exemplary embodiment of the present disclosure, the spacer elements can be developed as punctiform supporting elements. This provides advantages in respect of manufacturing technology, wherein, for example, in the case of an arrangement of the punctiform supporting elements which is offset correspondingly diagonally with respect to the axial direction, an improved cooling effect is likewise achieved. A punctiform supporting element has, for example, a circular outline, for example, with a diameter of 4 cm, and a height of likewise 4 cm, depending on the desired design of the dispersion or cooling channel.

In accordance with an exemplary embodiment the dry-type transformer of the present disclosure, a respective hollow-cylindrical third winding segment, which is nested between the respective first winding segment and second winding segment, is provided, wherein in each case one cooling channel is provided between the respective winding segments. According to an exemplary embodiment, the at least one radially inner first winding segment and the at least one radially outer second winding segment is intended for low voltage and the at least one radially central third winding segment is provided for high voltage. By virtue of the atypical arrangement of the high-voltage winding, for example, with a rated voltage of 15 kV, between two low-voltage windings, for example, with a rated voltage of 0.4 kV, the short-circuit impedance of the transformer is advantageously increased, which then results in reduced short-circuit currents in the event of a fault. The radially inner winding is intended for supplying power to a train heater, for example, while the radially outer winding is then intended for supplying power to the drive.

In accordance with an exemplary embodiment of the present disclosure, the transformer core has precisely two limbs, around which in each case at least one first winding segment and one second winding segment can be arranged. The two-limb embodiment is particularly advantageous taking into consideration the single-phase nature of a railroad power supply grid. The distribution of the respective low-voltage and high-voltage windings among the two limbs results in increased utilization of the amount of space available and therefore in a design of the transformer of the present disclosure which is as compact as possible.

In accordance with an exemplary embodiment of the dry-type transformer of the present disclosure, the dry-type transformer is arranged in a housing surrounding the transformer. The housing has an inlet opening and an outlet opening, wherein air baffles can be provided within the housing. The air baffles can be arranged in such a way that a coolant entering through the inlet opening is guided along respective nested winding segments in a serpentine fashion through the housing or the cooling channels or in dispersion channels formed therein to the outlet opening. Firstly, the housing provides mechanical protection for the transformer, which is particularly advantageous in the case of the arrangement in the underfloor region. The guidance of the cooling air along channels fixed by air baffles, for example, through the cooling or dispersion channels, improves the cooling effect. By virtue of the serpentine-like guidance of the cooling air along respective winding segments, a situation is achieved in particular for the embodiment with two nested winding segments, in which the inlet and outlet opening can be on the same side of the transformer housing. This facilitates the installation or removal of such a transformer for maintenance purposes. In accordance with an exemplary embodiment, a fan is provided in order to press cooling air through the winding segments.

In accordance with an exemplary embodiment of the present disclosure, the housing and holding structures used therein, such as the press bars for the transformer core, for example, can be manufactured with a lightweight construction, for example, from aluminum. The weight of the transformer is thus advantageously reduced, which is particularly advantageous owing to the intended mobile use of the transformer, for example, in rail-mounted vehicles.

According to an exemplary embodiment, vibration-damping supporting elements which can be matched to the shape of the respective resting areas can be provided. The dry-type transformer is supported and/or fixed on the resting areas by means of the supporting elements. By virtue of the, for example, wedge-like supporting elements which may be constituted by hard rubber, for example, being matched to the outer shape of the respective resting areas, a homogeneous compressive loading of the resting areas is ensured. Owing to the vibration-damping properties of the supporting elements, both the natural oscillation of the transformer during operation, for example, 16⅔ Hz, and impact effects as a result of the movement of a locomotive, for example, in which the transformer is integrated can be damped.

According to an exemplary embodiment of the dry-type transformer of the disclosure, winding segments nested one inside the other can be cast with one another. This increases the mechanical stability of the electrical part of the winding and advantageously increases the respective compressive stress loading capacity. Casting or solidification of the winding is performed, for example, by means of epoxy resin. A strip-like prepreg material can possibly also be used as layer insulation between respective winding layers, which prepreg material is introduced during winding of the turns. In a final heating process, the transformer winding is heated and the B-stage resin contained in the prepreg is completely polymerized, which then results in mechanical stabilization of the respective windings.

Provision is made in one variant of the disclosure for respective first, respective second and/or respective third winding segments to be galvanically connected to one another. This can be performed both by means of a series circuit and by means of a parallel circuit. According to an exemplary embodiment, high-voltage windings can be connected in series for reducing the stress loading, and low-voltage windings can be connected in parallel for increasing the current loading capacity. A transformer according to an exemplary embodiment of the present disclosure can include a two-limb core with in each case two winding arrangements nested one inside the other. It is, of course, also possible for a plurality of respective first, second and/or third winding segments nested one inside the other in the same winding arrangement to be connected in series, for example.

Furthermore, the present disclosure also provides for the at least one first winding segment and the at least one second winding segment to be connected galvanically in series, with the result that an autotransformer is formed. This autotransformer optionally has a plurality of taps and is characterized by a particularly high power density.

Further advantageous possible configurations are explained below with reference to exemplary embodiments illustrated in the drawings.

FIG. 1 shows a section 10 through an exemplary hollow-cylindrical cooling channel, wherein the winding segments adjoining radially on the inside and on the outside can be not illustrated. A hollow-cylindrical cooling channel is formed between a radially outer boundary 12 and a radially inner boundary 14, in which cooling channel strip-like spacer elements 24, 26, 28 can be arranged in the radial direction. The spacer elements 24, 26, 28 extend along the axis of the winding. The spacer elements 24, 26, 28 can be manufactured, for example, from a glass-fiber-reinforced composite material or pressboard. Thus, channels 16, 18, 20, 22 can be formed along the axial extent between the spacer elements 24, 26, 28. According to an exemplary embodiment, the channels can be provided as cooling channels for the passage of air. The cooling channel is shown with its desired alignment, wherein the spacer elements 24, 26, 28 can be arranged more densely, i.e. with a smaller spacing from one another, in the lower region. Therefore, the pressure loading capacity of the cooling channel in its lower region is increased such that, hereby, the weight of a transformer or transformer core can be evened out without deformation of the cooling channel or the dispersion channel formed thereby taking place.

Figure 2:
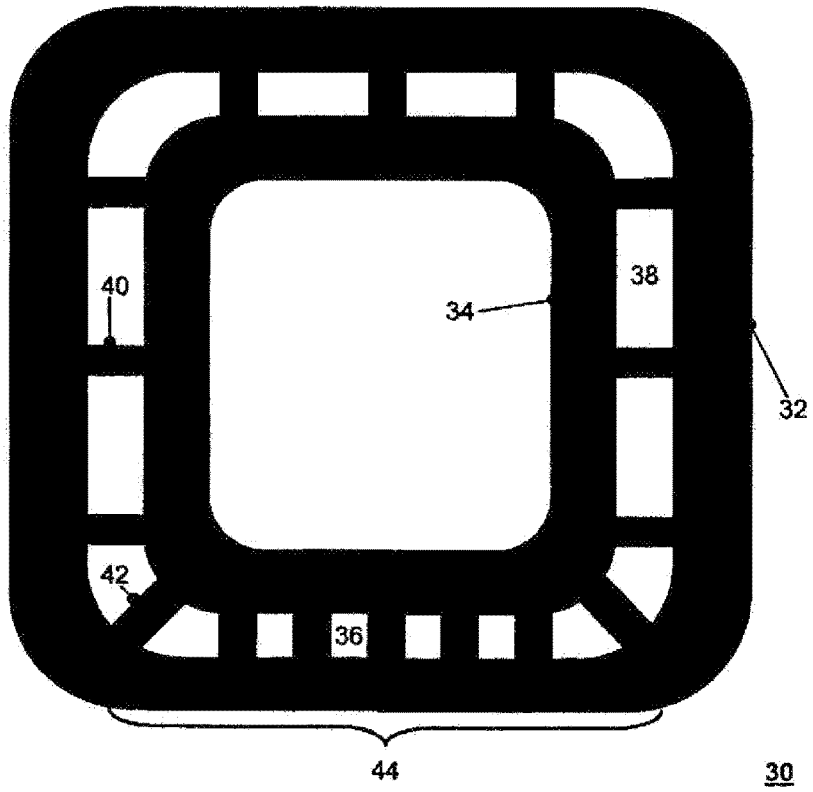
FIG. 2 shows a first section through exemplary winding segments nested one inside the other.

FIG. 2 shows a first section 30 through winding segments 32, 34 which can be nested one inside the other and which in this case have an approximately rectangular cross section. Such a cross-sectional form is advantageous for increasing the fill factor and/or for the maximum utilization of the limited space available in the underfloor region of a railroad car or a locomotive. The radial spacing of the first winding segment 34 and second winding segment 32 is performed by strip-like spacer elements 40, 42, wherein respective cooling channels 36, 38 can be formed therebetween. The winding segments nested one inside the other can be shown with their desired alignment (e.g., horizontally), wherein a resting area 44 is indicated in the lower region. In order to increase the compressive stress loading capacity of the winding segments nested one inside the other in the radial direction with respect to the resting area 44, the distribution of the spacer elements in the lower region is correspondingly condensed.

Figure 3:
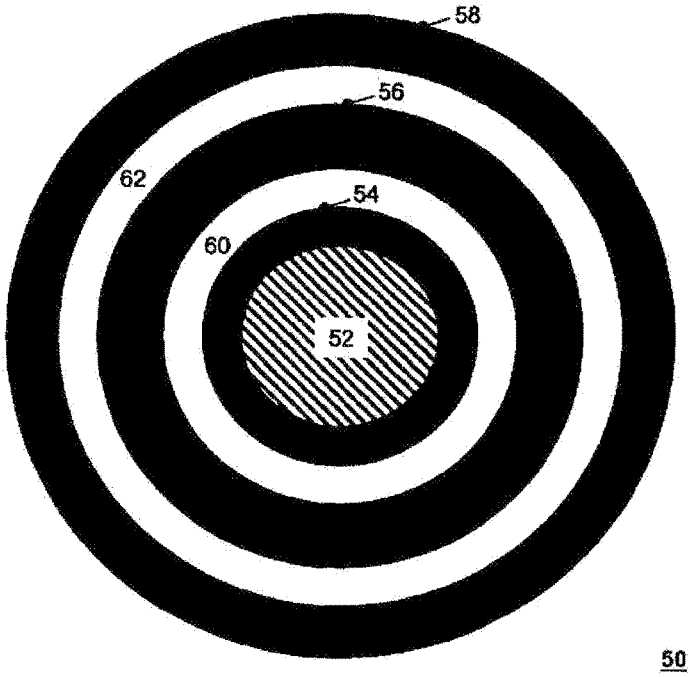
FIG. 3 shows a second section through exemplary winding segments nested one inside the other.

FIG. 3 shows a second section through winding segments 54, 56, 58 which can be nested one inside the other and which in this case have a circle-like cross section. Cooling channels 60, 62 acting as cooling channels can be formed between the winding segments 54, 56, 58, wherein the spacer elements provided in the cooling channels cannot be shown in this illustration. The radially inner first winding segment 54 surrounds a transformer core limb 52 and, from an electrical point of view, is a low-voltage winding, for example, a 400 V supply for a train heater. The radially central third winding segment represents a high-voltage winding, for example, a 15 kV winding, which is fed by an overhead line of a railroad power supply. The radially outer second winding 58 is a low-voltage winding and supplies power to, for example, the electrical drive of a locomotive.

Figure 4:
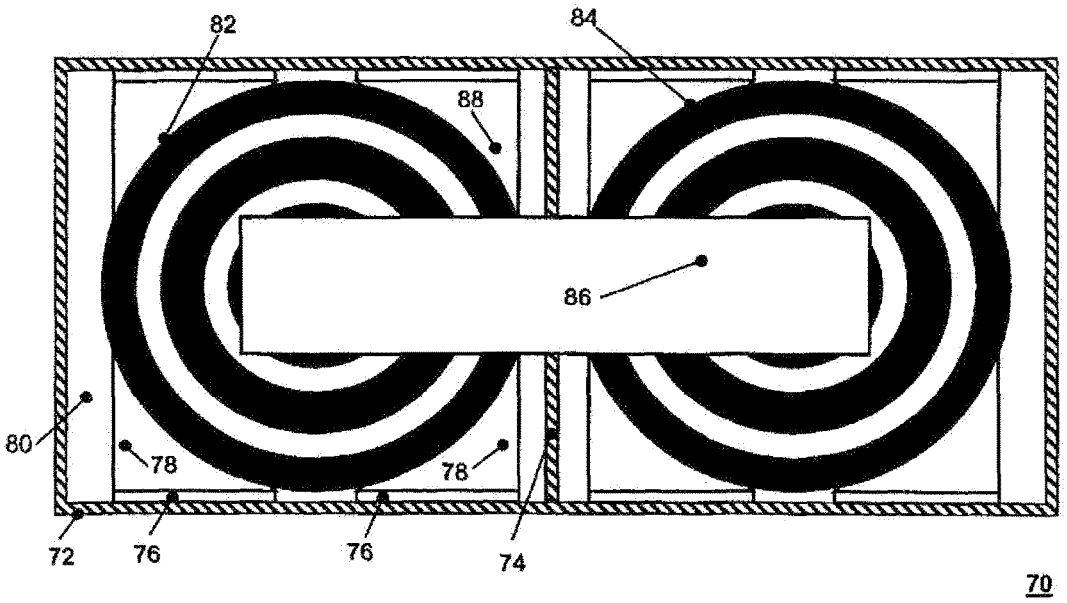
FIG. 4 shows a sectional view of a dry-type transformer according to an exemplary embodiment of the present disclosure.

FIG. 4 shows a lateral sectional view 70 of a dry-type transformer according to an exemplary embodiment of the present disclosure. A two-limb transformer core 86, which is enclosed at each of its limbs by respective arrangements of winding segments 82, 84 nested one inside the other, is arranged horizontally in an aluminum housing 72. In each case, three hollow-cylindrical winding segments can be nested one inside the other, wherein respective hollow-cylindrical cooling and/or dispersion channels can be provided radially therebetween. Wedge-like supporting elements 78, which may be constituted of a hard rubber material and which can be matched to the shape of the outer contour of the resting areas of the radially outer winding segments, can be provided in the respective lower regions of the arrangements of the winding segments nested one inside the other, via which supporting elements the weight of the windings and the transformer core is evened out proportionally downwards. The supporting elements for their part can be arranged on a respective intermediate element 76, for example, an aluminum strip. In the upper region, respective damping elements 88 with a similar shape can be provided which enable fixing of the windings 82, 84 or the transformer in the housing 72, but which do not of course serve to even out the weight. An air baffle 74 between the winding arrangements 82, 84 is used for developing a respective guide channel for coolant, which guide channel extends along the winding segments. The dimensions of the housing can be, for example, 0.7 m in height, 1.6 m in width and 2.4 m in length. By virtue of the horizontal arrangement, an arrangement in the underfloor region of a railroad car is possible despite the increased amount of space required for the cooling channels.

Figure 5:
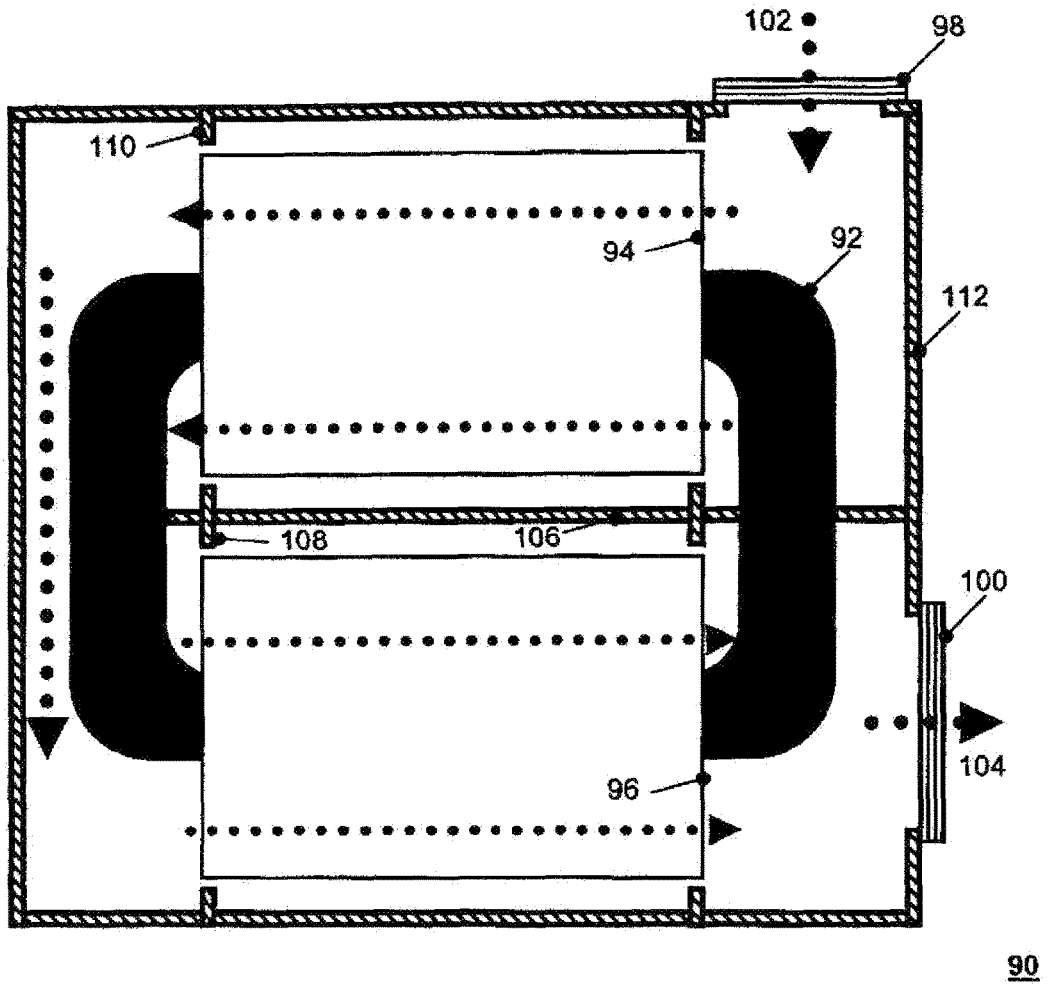
FIG. 5 shows a sectional view of a dry-type transformer according to an exemplary embodiment of the present disclosure.

FIG. 5 shows a sectional view 90 of an exemplary embodiment of a dry-type transformer of the present disclosure. The dry-type transformer substantially corresponds to the dry-type transformer shown in FIG. 4, but is illustrated in a perspective plan view. A two-limb transformer core 92, which is surrounded on both of its limbs by hollow-cylindrical winding segments 94, 96 nested one inside the other, is arranged horizontally in a housing 112. The housing 112 has an inlet opening 98 and an outlet opening 100. A serpentine-like guidance of inflowing air 102 through the housing is ensured by means of air baffles 106, 108, 110. The air introduced with a fan, for example, is heated as it flows through the inner housing in the direction indicated by corresponding arrows and then emerges again as heated air flow 104 at the outlet opening 100.

It should be noted that the term "including" or "comprising" does not exclude other elements or steps, and that the indefinite article "a" or "an" does not exclude the plural. Also, elements described in association with different embodiments may be combined.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Section through exemplary hollow-cylindrical cooling channel
12 Radially outer boundary of cooling channel
14 Radially inner boundary of cooling channel
16 First cooling channel segment
18 Second cooling channel segment
20 Third cooling channel segment
22 Fourth cooling channel segment
24 First spacer element of cooling channel
26 Second spacer element of cooling channel
28 Third spacer element of cooling channel
30 First section through winding segments nested one inside the other
32 Radially outer second winding segment
34 Radially inner first winding segment
36 First cooling channel segment of nested winding segments
38 Second cooling channel segment of nested winding segments
40 First spacer element
42 Second spacer element
44 Resting area
50 Second section through winding segments nested one inside the other
52 Transformer core limb
54 First winding segment
56 Third winding segment
58 Second winding segment

60 First cooling channel
62 Second cooling channel
70 Sectional view of exemplary first dry-type transformer
72 Housing
74 First air baffle
76 Intermediate element
78 Supporting element
80 Air channel
82 First winding segments nested one inside the other
84 Second winding segments nested one inside the other
86 Transformer core yoke
88 Damping element
90 Sectional view of exemplary second dry-type transformer
92 Transformer core
94 First winding segments nested one inside the other
96 Second winding segments nested one inside the other
98 Inlet opening
100 Outlet opening
102 Inflowing air
104 Outflowing air
106 Second air baffle
108 Third air baffle
110 Fourth air baffle
112 Housing

What is claimed is:

1. A dry-type transformer for mobile applications, comprising:

a transformer core;

at least one radially inner first hollow-cylindrical winding segment having an outermost surface that is continuous along an outer circumference of the at least one first winding segment;

at least one radially outer second hollow-cylindrical winding segment having an innermost surface that is continuous along an inner circumference of the at least one second winding segment, the winding segments being wound around a common winding axis, having the transformer core passing through them, being nested one inside the other, and being spaced radially apart from one another such that a hollow-cylindrical cooling channel extends between the winding segments in an axial direction substantially parallel to the common winding axis; and spacer elements arranged to space apart the winding segments in a radial direction perpendicular to the axial direction, the spacer elements being arranged such that a coolant is flowable through the cooling channel in the axial direction, wherein the spacer elements are arranged along a radial circumference of the cooling channel over an axial length of the cooling channel such that a proportional weight of the dry-type transformer arranged horizontally can be evened out exclusively at precisely one resting area of the at least one second winding segment without deformation of the cooling channel taking place, wherein each of the spacer elements respectively has a first surface contacting and extending along the outermost surface of the at least one first winding segment, a second surface contacting and extending along the innermost surface of the at least one second winding segment, a third surface extending entirely in the radial direction between the first and second surfaces, and a fourth surface extending entirely in the radial direction between the first and second surfaces, the first and second surfaces being perpendicular to the third and fourth surfaces, respectively, and wherein the spacer elements are arranged in condensed form in a radial circumferential direction in the respective resting area, such that an increased capacity for radial compressive stress results in corresponding regions of the cooling channel, the radial circumferential direction extending along the outer circumference of the at least one first winding segment, and the inner circumference of the at least one second winding segment.

2. The dry-type transformer as claimed in claim 1, wherein the spacer elements are in the form of at least one of strips and channels.

3. The dry-type transformer as claimed in claim 2, wherein the spacer elements extend along the winding axis.

4. The dry-type transformer as claimed in claim 1, wherein the spacer elements are developed as punctiform supporting elements.

5. The dry-type transformer as claimed in claim 1, comprising:

a respective hollow-cylindrical third winding segment, which is nested between the respective first winding segment and second winding segment, wherein in each case one cooling channel is provided between the respective winding segments.

6. The dry-type transformer as claimed in claim 5, wherein the at least one radially inner first winding segment and the at least one radially outer second winding segment are configured for low voltage, and wherein the third winding segment is provided for high voltage.

7. The dry-type transformer as claimed in claim 1, wherein the transformer core has precisely two limbs, around which in each case the at least one first winding segment and the at least one second winding segment are arranged.

8. The dry-type transformer as claimed in claim 1, wherein the dry-type transformer is arranged in a housing surrounding the dry-type transformer, wherein the housing has an inlet opening and an outlet opening, wherein air baffles are provided within the housing, the air baffles being arranged such that coolant entering through the inlet opening is guided along respective nested winding segments in a serpentine fashion through at least one of the housing, the cooling channels and in cooling channels formed therein to the outlet opening.

9. The dry-type transformer as claimed in claim 8, wherein the housing and holding structures comprised therein are manufactured with a lightweight construction.

10. The dry-type transformer as claimed in claim 1, comprising:

vibration-damping supporting elements which are matched to a shape of respective resting areas, by means of which supporting elements the dry-type transformer is at least one of supported and fixed on the resting areas.

11. The dry-type transformer as claimed in claim 1, wherein the winding segments nested one inside the other are cast with one another.

12. The dry-type transformer as claimed in claim 1, wherein at least one of the respective first winding segments, the respective second winding segments and respective third winding segments are galvanically connected to one another.

13. The dry-type transformer as claimed in claim 1, wherein the at least one first winding segment and the at least one second winding segment are connected galvanically in series to form an autotransformer.

14. The dry-type transformer as claimed in claim 1, wherein the radial direction is perpendicular to the common winding axis around which the winding segments are wound, wherein the spacer elements arranged in the condensed form in the resting area are arranged closer to each other in the axial direction than the spacer elements arranged in other areas of the winding segments separate from the resting area, and wherein the resting area is arranged on a lower end of the transformer and is configured to support the weight of the transformer arranged in the horizontal direction.

* * * * *